US006923518B2

(12) United States Patent
Kim

(10) Patent No.: US 6,923,518 B2
(45) Date of Patent: Aug. 2, 2005

(54) DRAWER SLIDE AND DRAWER SLIDE ADJUSTMENT MECHANISM

(75) Inventor: Daniel M. Kim, Santa Fe Springs, CA (US)

(73) Assignee: Accuride International Inc., Santa Fe Springs, CA (US)

( * ) Notice: Subject to any disclaimer, the term of this patent is extended or adjusted under 35 U.S.C. 154(b) by 35 days.

(21) Appl. No.: 10/353,123

(22) Filed: Jan. 27, 2003

(65) Prior Publication Data

US 2004/0145286 A1 Jul. 29, 2004

(51) Int. Cl.[7] ..... A47B 88/00
(52) U.S. Cl. ..... 312/334.4; 312/334.5; 312/334.7; 312/334.8
(58) Field of Search ..... 312/334.4, 334.5, 312/334.7, 334.8

(56) References Cited

U.S. PATENT DOCUMENTS

| | | | | | |
|---|---|---|---|---|---|
| 2,698,214 | A | * | 12/1954 | Skamser | 312/334.5 |
| 2,928,696 | A | * | 3/1960 | Hiers | 384/19 |
| 4,810,045 | A | | 3/1989 | Lautenschläger | |
| 4,842,422 | A | | 6/1989 | Nelson | |
| 5,257,861 | A | * | 11/1993 | Domenig et al. | 312/334.5 |
| 5,375,922 | A | | 12/1994 | Brüstle et al. | |
| 5,439,283 | A | | 8/1995 | Schröder et al. | |
| 5,556,182 | A | * | 9/1996 | Lai | 312/334.19 |
| 5,588,729 | A | | 12/1996 | Berger | |
| 5,664,855 | A | * | 9/1997 | Lautenschlager et al. | 312/334.4 |
| 5,842,759 | A | * | 12/1998 | Ferrari et al. | 312/334.5 |
| 6,497,464 | B1 | | 12/2002 | Cammack et al. | |
| 6,585,336 | B2 | * | 7/2003 | Munday et al. | 312/334.4 |
| D488,712 | S | | 4/2004 | Kim | |
| 2002/0089274 | A1 | | 7/2002 | Liang et al. | |
| 2002/0190618 | A1 | * | 12/2002 | Salice | 312/334.4 |
| 2003/0001472 | A1 | | 1/2003 | Kim et al. | |
| 2004/0145286 | A1 | | 7/2004 | Kim | |

FOREIGN PATENT DOCUMENTS

| | | |
|---|---|---|
| DE | 2 462 538 A1 | 8/1977 |
| EP | 1 093 735 A1 | 8/2000 |
| GB | 1582894 | 1/1981 |
| JP | 6-211471 | 8/1994 |

OTHER PUBLICATIONS

European Office Action dated Aug. 27, 2004 in connection with European Application No. 03 257 387.5–2313 (4 pgs.).
Office Action for U.S. Appl. No. 10/453,842, filed Jun. 2, 2003, Office Action mailed Sep. 20, 2004 (8 pgs.).
U.S. Appl. No. 10/453,842, filed Jun. 2, 2003.
Accuride data sheet for "Accu–Flach Typ 7520" Belastung bis 250N, 484–1 –0292, Part No. 26003300 (1 page double sided), date unknown.
European Search Report for European Application No. 03257387.5, Search Report completed Apr. 23, 2004 and mailed May 17, 2004 (4 pgs.).

* cited by examiner

*Primary Examiner*—Peter M. Cuomo
*Assistant Examiner*—Sarah C. Burnham
(74) *Attorney, Agent, or Firm*—Christie, Parker & Hale, LLP

(57) ABSTRACT

A drawer slide and drawer slide adjustment mechanism. A drawer slide includes an aperture about which a camming mechanism or lever is attached to, or operates on, the drawer slide. A screw or pin may be placed through a portion of the camming mechanism and through the aperture. Movement of the camming mechanism results in movement of a drawer with respect to the drawer slide during installation.

25 Claims, 17 Drawing Sheets

Prior Art

Prior Art

DRAWER SLIDE AND DRAWER SLIDE ADJUSTMENT MECHANISM

BACKGROUND OF THE INVENTION

The present invention relates generally to drawer slides, and more particularly to a drawer slide with an installation adjustment mechanism.

Drawer slides are often used to extendably couple drawers, trays, and rack mounted equipment to cabinets, racks and the like. Drawer slides generally have one elongate member coupled to a cabinet or rack, and another elongate member attached to the drawer or equipment. The elongate members are slidably, or rollably, coupled so as to be able to longitudinally extend with respect to one another. This extension allows easy access to the drawer or equipment.

Drawer slides, particularly side mounted drawer slides, are often used in pairs, with a drawer slide on each side of the drawer. For each drawer slide a cabinet member is attached to the cabinet and a drawer member is attached to the drawer with the cabinet member and the drawer members are slidably, or rollably, coupled by, bearings, for example. Intermediate slide members may also be positioned between the cabinet and drawer member.

During installation the cabinet members are generally attached to opposing sides of the cabinet, and the drawer members are attached to the drawers. The cabinet members and the drawer members are then interfit by placing the drawer within the cabinet. Difficulties may arise, however, if the cabinet members and drawer members are not properly installed. For example, if a drawer member is not parallel with the associated cabinet member, the members may bind or prevent movement of the slide. In some cases alignment may be sufficiently out of tolerance so that no movement or even interfit of the members is possible. In addition, the drawer may not be level, or may not be properly positioned in a face frame cabinet, depending on the relative position of the slides on each side of the drawer. Accordingly, proper installation of the drawer slides is of some importance, and may be a time consuming process, particularly for those without skill, aptitude, or experience in performing such tasks.

SUMMARY OF THE INVENTION

The present invention provides a drawer slide and drawer slide adjustment mechanism. In one aspect, the invention provides a drawer slide assembly having an adjustment mechanism comprising a first slide member; a second slide member slidably coupled to the first slide member; an adjustment member pivotably attached to the second slide member about a first point of the adjustment member, the adjustment member having a second point moveable through a distance free of the second slide member.

In another aspect the invention provides a drawer slide assembly comprising a first slide member; a second slide member longitudinally extendably coupled to the first slide member; and means to adjust the lateral position of the second slide member.

These and other aspects of the invention will be more readily understood with reference to the figures and detailed description.

DETAILED DESCRIPTION

Figure 1:
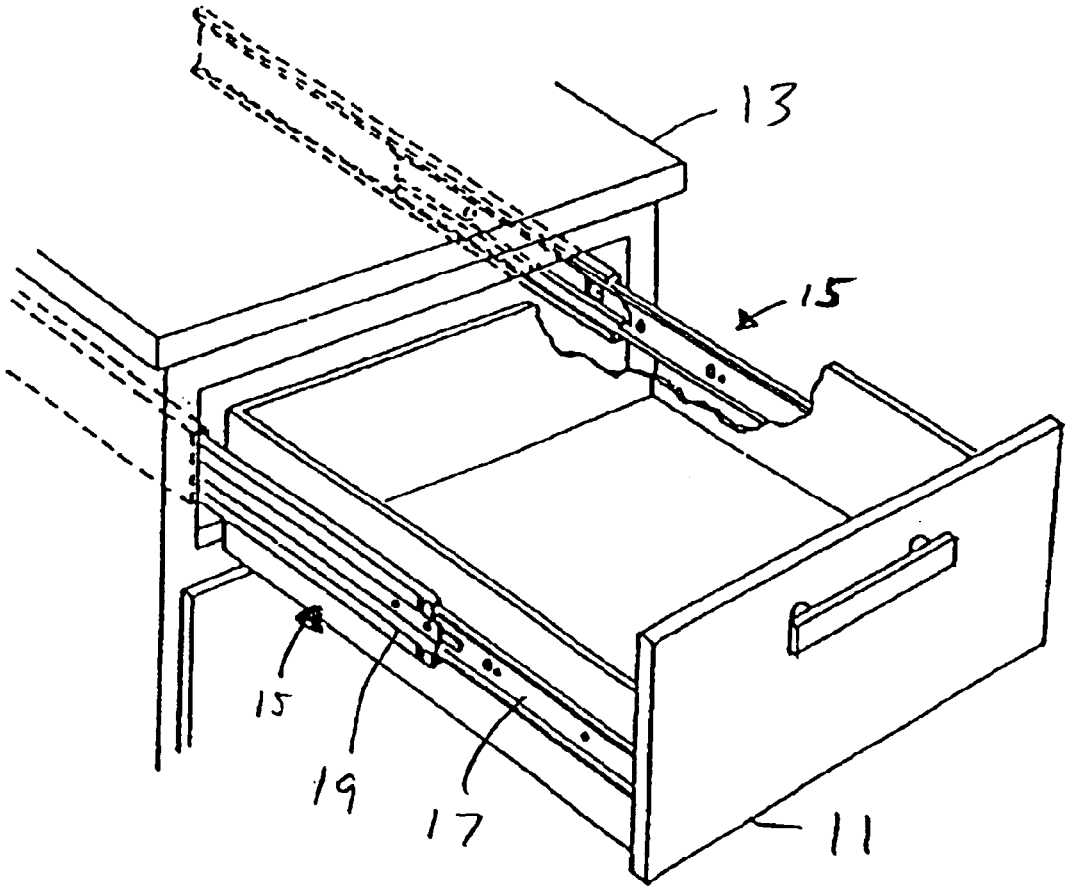
FIG. 1 illustrates a drawer extending from a cabinet.

FIG. 1 illustrates a drawer extended from a cabinet. The drawer is extended from the cabinet using drawer slides. As illustrated, the drawer slides are three-member full extension telescopic drawer slides. Generally, a three member telescopic drawer slide has an elongate inner member 17 nested within an elongate intermediate member 19, which in turn is nested within an elongate outer member. The outer member is often mounted to a cabinet, the inner mounted to a drawer, and the intermediate member coupling the outer and inner members. The inner member extends from the intermediate member in a telescoping action, and the intermediate member extends from the outer member in a telescoping action. Although a telescopic drawer slide is illustrated in FIG. 1, other drawer slides may be used in place of the telescopic drawer slide. For example, an over and under drawer slide may be used, or a number of other drawer slides known in the art.

Figure 2:
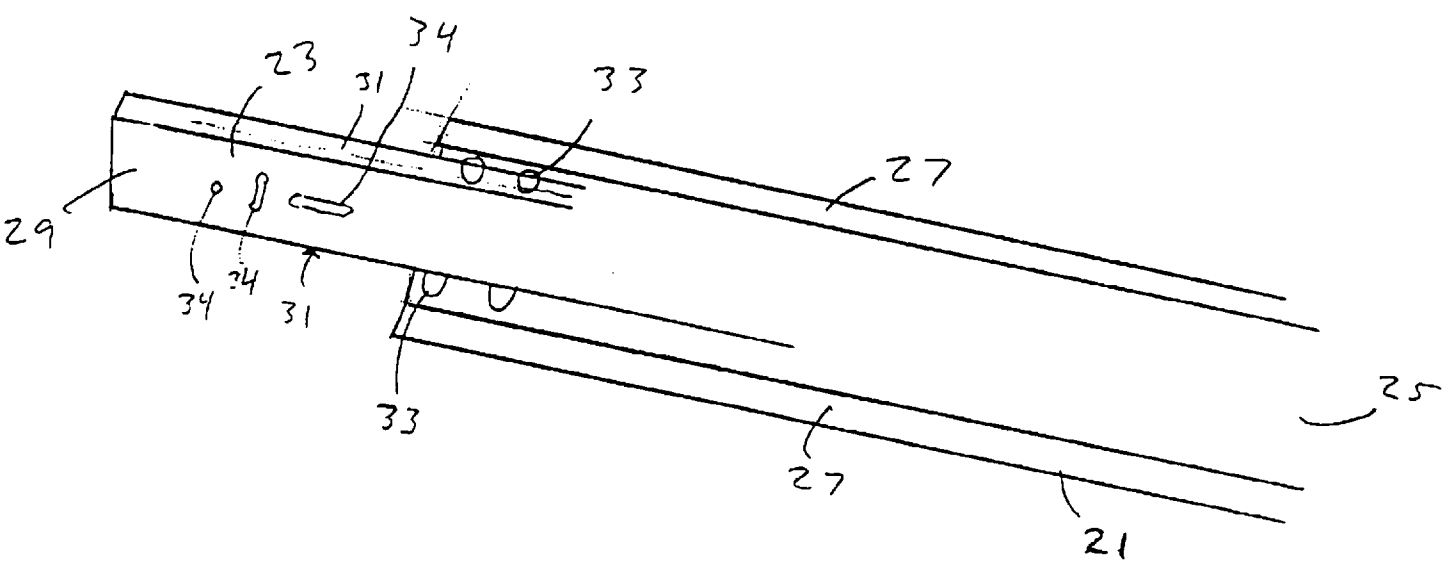
FIG. 2 Prior Art
FIG. 2 illustrates a two-member telescopic drawer slide.

A two-member telescopic drawer slide is illustrated in FIG. 2. As illustrated, the drawer slide includes an outer member 21 and an inner member 23. The outer member includes a substantially elongate web 25. Arcuate bearing raceways 27 extend from the longitudinal margins of the web, forming bearing raceways. Similarly, the inner member includes a longitudinal web 29, with arcuate bearing raceways 31 extending from the longitudinal portions of the web. Bearings 33 riding in the raceways couple the slides together. Apertures 34 within the webs are adapted to receive screws and the like to couple the webs to a cabinet or a drawer (shown in FIG. 1).

Figure 3:
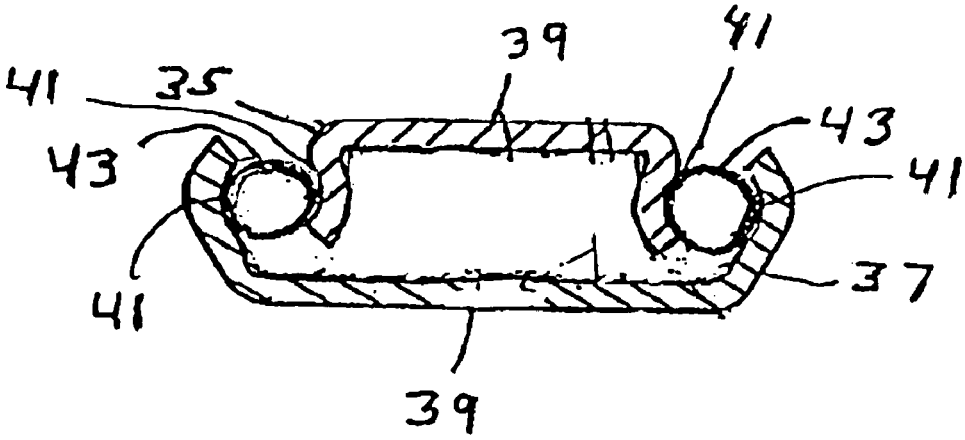
FIG. 3 illustrates a cross-section of the slide of FIG. 2.

A cross-section of the slide of FIG. 2 is illustrated in FIG. 3. As may be seen in FIG. 3, an inner member 35 is nested within an outer member 37. Both the inner member and the outer member include a web 39, with bearing raceways 41 extending from opposing edges of the webs. Bearings 43 ride within the bearing raceways, and serve to couple the inner member and outer member.

Returning to FIG. 1, the outer drawer slide is coupled to a cabinet, and the inner member is coupled to the drawer. Generally the outer member and inner members are independently coupled to the cabinet and the drawer, respectively. This is often accomplished by passing screws or the like through apertures in the slide member webs. The inner member is then interfit within the outer member by placement of the drawer within the cabinet. Various locking release mechanisms may be used to prevent the inner member from overly extending from the outer member and thereby release the drawer from the cabinet.

Figure 4:
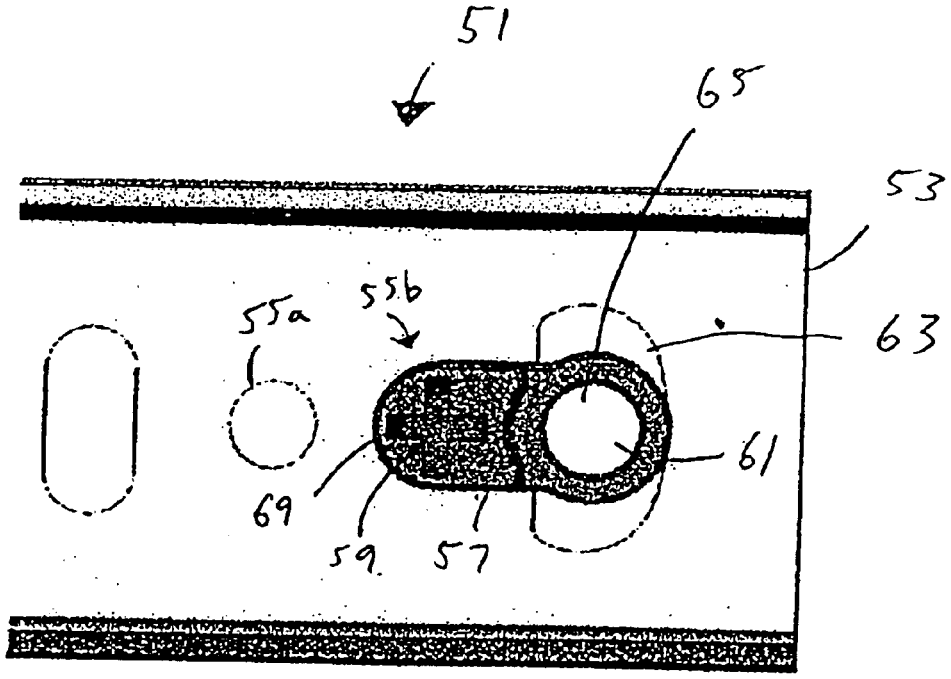
FIG. 4 illustrates a portion of an inner slide member with an adjustment mechanism in accordance with aspects of the invention.

FIG. 4 illustrates a portion of an inner member 51 in accordance with the aspect of the invention. The inner member includes a web 53. Apertures 55*a* and 55*b* are formed in the web. An adjustment member 57 is attached to the web about aperture 55*b*. In the embodiment of FIG. 4, the adjustment member is a cam mechanism with a first point 59 fixed in position with respect to the slide. As illustrated in FIG. 4, the first point is fixed with respect to the position of the web, and this is accomplished through the use of a rivet, a stake, or other means in various embodiments.

A second point 61 on the cam mechanism is displaced from the first point and the second point is rotatable about the first point. The second point overlays an elongate aperture 63 within the web. The elongate aperture is sufficiently large such that as the cam rotates about the first point a portion of the movement of the second point is approximate the aperture. In a system of FIG. 4, the second point of the cam moves in an arc. Accordingly, the elongate aperture forms somewhat of an outline of an arc. In other embodiments, however, the aperture is of rectangular shape. As movement of the cam within the aperture is limited, rotation of the cam does not result in significant linear movement of the second point with respect to the longitudinal direction of the inner member web.

Figure 5:
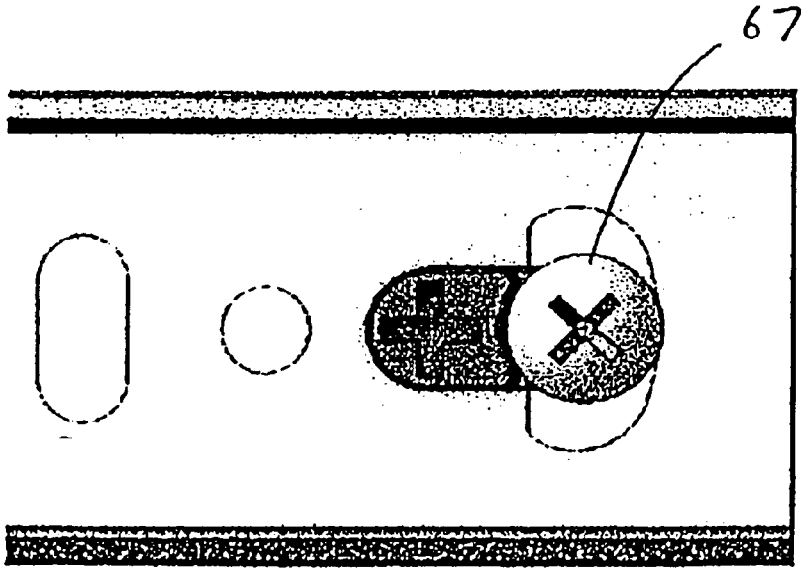
FIG. 5 illustrates the slide member and adjustment mechanism of FIG. 4.

As illustrated in FIG. 4, a screw hole 65 is centered on the second point. The screw hole is adapted to receive a screw 67, as illustrated in FIG. 5. As the second point and screw hole overlay the elongate aperture, a screw passed through the screw hole also passes through the elongate aperture.

In the embodiment of FIG. 4, the cam includes a screw head 69 about the first point. As illustrated the screw head is a phillips screw head. Insertion of a screwdriver (not shown) into the screw head allows for rotation of the cam through use of the screwdriver.

In some embodiments the camming mechanism is placed towards the front of the inner member. During installation the rear of the inner member is first affixed to the drawer with a single screw. This allows the inner member to pivot about a point towards the rear of the inner member. A screw is passed through the hole of the camming mechanism to couple the front of the inner member to the drawer, although in other embodiments pins or the like are used. Once the screw is screwed into the drawer, rotation of the cam about the first point results in a movement of the inner member with respect to the drawer. Thus, the camming mechanism effectively operates on the inner member to result in relative movement of the inner slide member and drawer.

As most drawers include horizontally mounted drawer slides, movement of the cam primarily results in vertical offset of the forward end of the inner member. Further tightening of the screw, however, binds the web against the drawer, and fixes the drawer in position with respect to the inner member. Other screws then may be placed through other apertures in the web to more securely fix the position of the inner member with respect to the drawer.

In other embodiments, canning mechanisms are placed both towards the front of the inner member and towards the rear, at least somewhat, of the inner member. The multiple camming mechanisms allow for increased relative movement of the inner member and drawer. In particular, the use of two camming mechanisms allows for increased vertical alignment of a drawer front with respect to a cabinet face. As may be understood, the use of two camming mechanisms is accomplished with greater ease with full extension slide assemblies, particularly where the intermediate slide member includes access apertures to allow for adjustment of the rear camming mechanism.

Figure 6:
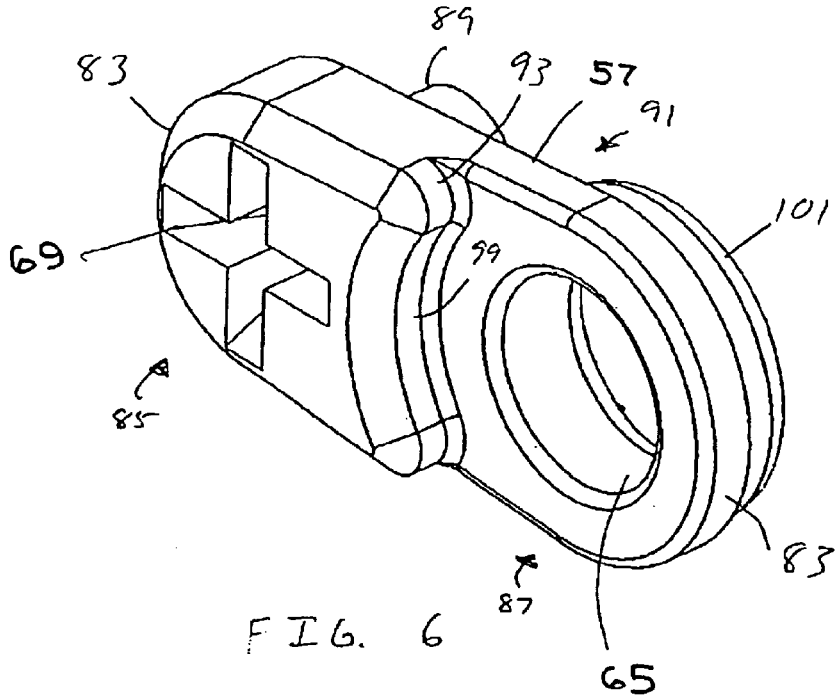
FIG. 6 illustrates an embodiment of a cam used with the slide of FIG. 4.

FIG. 6 illustrates an embodiment of the cam. As illustrated the adjustment member 57 or cam is somewhat link shaped, with a partially planar body having semicircular ends 83. The cam may be viewed as comprising two portions, the portions being a fixed end 85 and a free end 87. The fixed end includes a rivet 89 extending perpendicular from the planar body. The rivet extends from the planar body on the side 91 of the planar body that is adapted to be placed against the web of a slide member (not shown). A built-up portion 93 forms a table on the fixed end on the side Opposing the rivet. The table includes an inset screw head 69. The screw head, as illustrated, is adapted to receive the head of a screwdriver, which may be used to rotate the cam, particularly the free end of the cam. The screw head may be viewed as an adjustment point, and in various embodiments may take the form of a phillips head, a posidrive head, a flat head, a torque wrench head, an allen wrench head, or other forms.

The free end of the cam includes an aperture 65 through the planar body. The aperture is adapted to receive a screw or the like, and the table of the fixed end has an arc-shaped edge 99 to facilitate placement of the screw. On the side of the planar body adapted to face the web, a flange, or rib, 101 surrounds the aperture. The flange is approximate, or less than, the thickness of a slide member web. The flange serves to maintain position of the aperture within the bounds of the elongate aperture when the flange is placed within an elongated aperture in the slide member web. Moreover, this is accomplished without the flange extending past the surface of the slide member, and thereby contacting the drawer.

Figure 7:
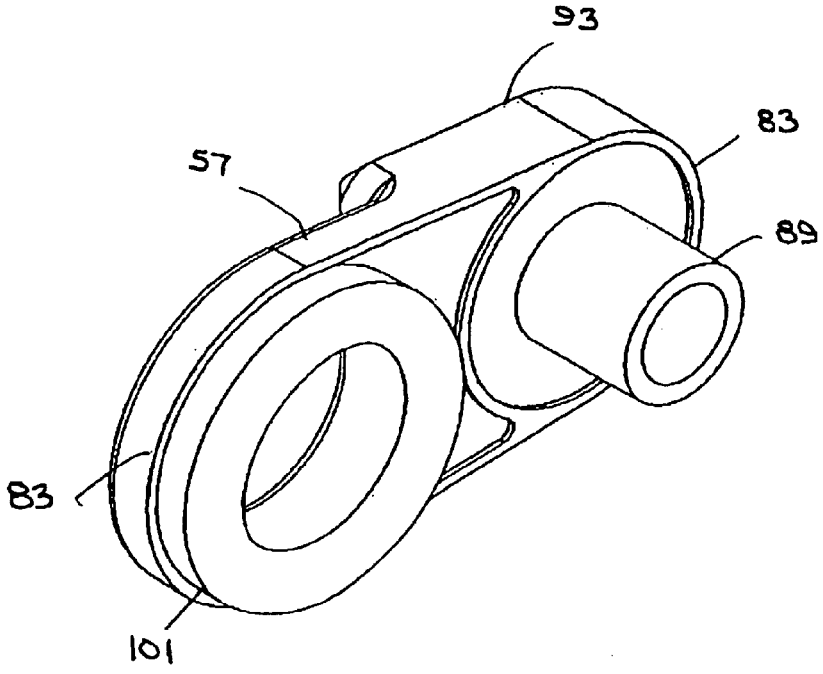
FIG. 7 illustrates a further view of the cam of FIG. 6.

FIG. 7 illustrates a further view of the cam of FIG. 6. In FIG. 7 a somewhat link-shaped adjustment member 57 or cam includes a partially planar body with semicircular ends 83. A rivet 89 and a flange 101 extend on one side of the partially planar body. The rivet extends from a first portion of the planar body. The flange extends around and surrounds an aperture in a second portion of the body. A built-up portion 93 on an opposite side of the body from the rivet includes a rotation mechanism.

Figure 8:
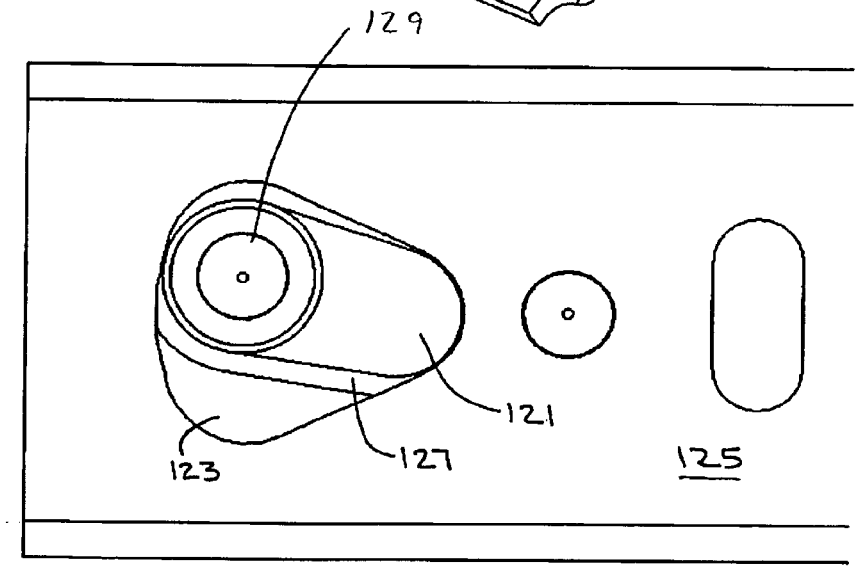
FIG. 8 illustrates a further slide member and adjustment mechanism in accordance with aspects of the invention.

FIG. 8 illustrates a further embodiment of the invention. In the embodiment of FIG. 8 a replaceable insert 121 is used to provide the cam mechanism. The replaceable insert forms a lever bar. The lever bar is adapted to fit partially within a somewhat triangular arc shaped cutout 123 in a slide member web 125.

The lever bar includes an inset portion 127 on one face. The inset portion is about the periphery of the lever bar. The inset portion fits snugly in the cutout. The cutout allows the lever bar to be moved, or rotated or pivoted within the aperture. The pivoting end of the lever bar includes a screw hole. In one embodiment, a screw is passed through the screw hole 129. The position of the slide is thereafter adjusted by moving the slide member relative to the lever bar.

Figure 9:
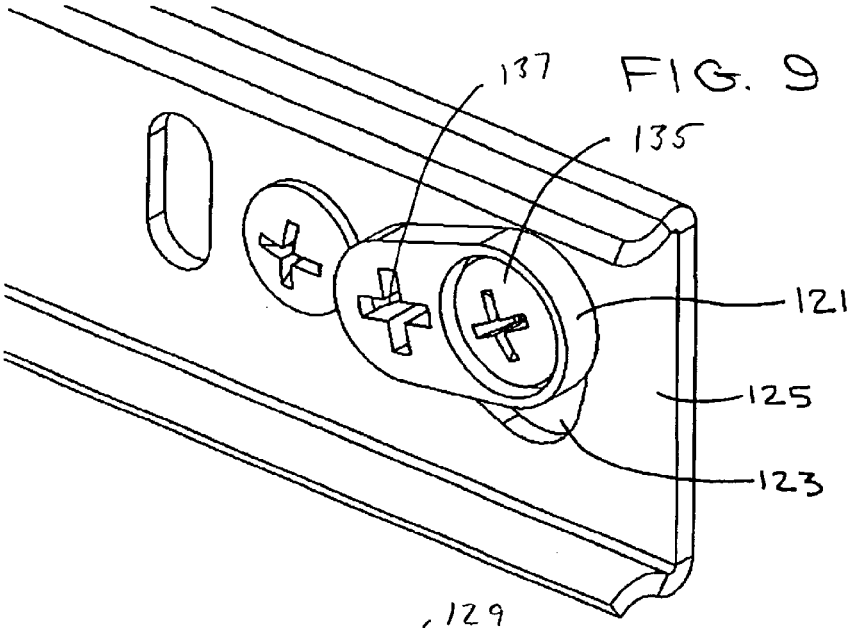
FIG. 9 illustrates the slide member and adjustment mechanism of FIG. 8.

The embodiment of FIG. 8 with a screw 135 placed in the screw hole may be seen in FIG. 9. In FIG. 9 the lever bar is partially placed within the aperture. The screw is placed in the screw hole. A pivot point 137 is on an opposing side of the lever bar than the screw. As illustrated the pivot point is a phillips screw head. A rotation of the pivot point causes the position of the screw to pivot with respect to the slide member. As the screw is placed into the side of a drawer, however, movement of the pivot point results in movement of the slide with respect to the drawer. Thus, the slide may be adjusted with respect to the drawer.

Figure 10:
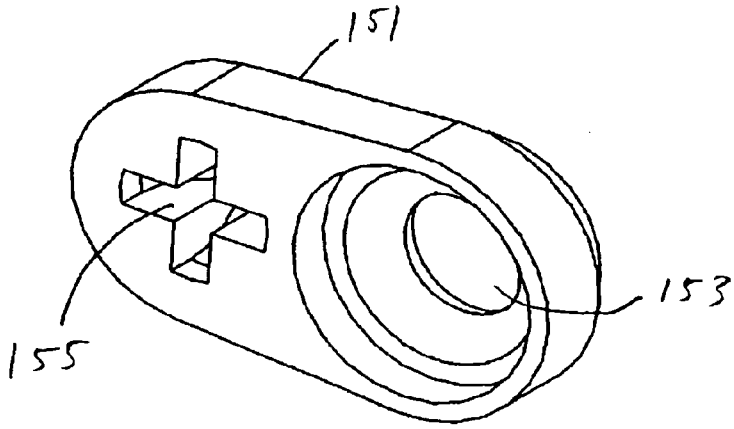
FIG. 10 illustrates a lever bar used with the embodiment of FIG. 8.
Figure 11:
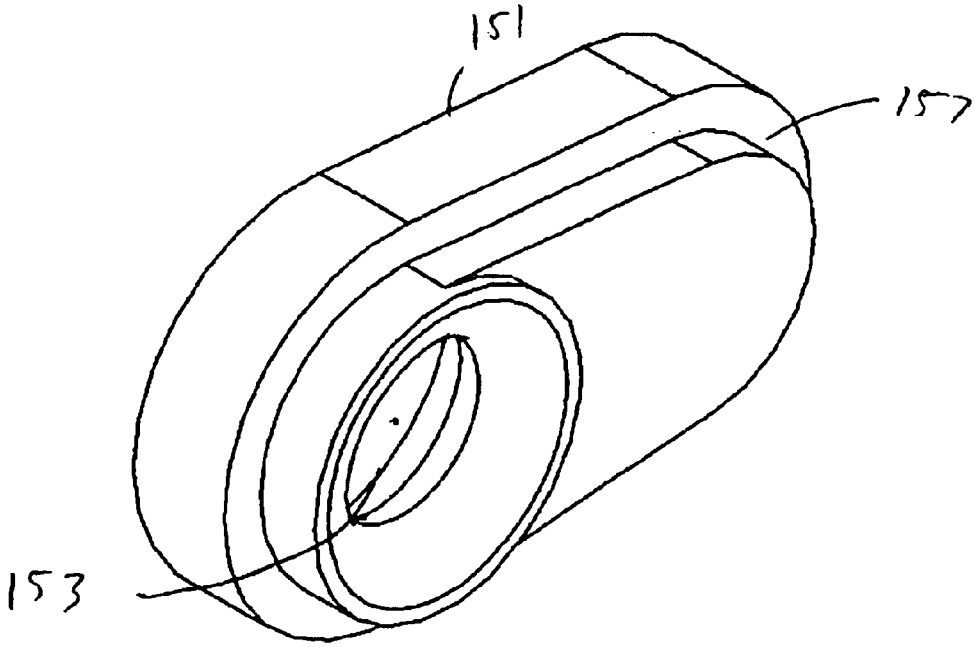
FIG. 11 shows another view of the lever bar of FIG. 10.

FIGS. 10 and 11 illustrate the lever bar of FIGS. 8 and 9. The lever bars are somewhat of an elongate oval shaped planar body 151. Approximate one end of the planar body is a screw hole 153. As illustrated the screw hole is inset, allowing a screw to be stably supported within the screw hole. Opposing the screw hole is a phillips screw head 155, which may be used to pivot or rotate the lever bar.

FIG. 11 shows another view of the lever bar of FIG. 10. In FIG. 11 it may be seen that the lever bar includes a cut-out 157, or inset, portion around its outer edge. The cut-out portion forms a step. The height of the step is approximate that of the width of a slide member. The step, therefore, may be placed within the bounds of an aperture, or cutout, of the slide member, as illustrated in FIGS. 8 and 9. Moreover, the lever bar of FIGS. 10 and 11 may be placed stably in the aperture without need for permanent attachment of the lever bar to the slide member.

Figure 12:
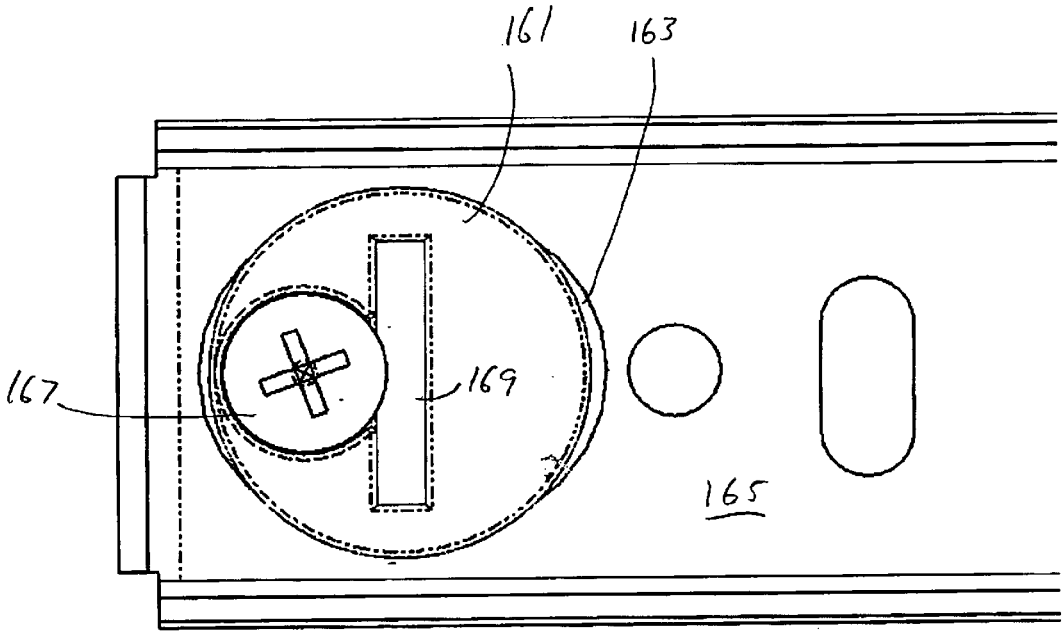
FIG. 12 illustrates a further embodiment of the invention.

FIG. 12 illustrates a further embodiment of the invention. In the embodiment of FIG. 12 a circular plate 161 is placed within an aperture 163 of a slide member web 165. The aperture is sufficiently large to hold the plate, but is oblong shaped. In some embodiments the plate is formed with a step to sit within the aperture, in a manner similar to the embodiments of FIGS. 8 through 11.

The plate includes an aperture adapted to receive a screw 167 and a slot 169 adapted to receive, for example, a screwdriver head for ease of rotation of the plate. In operation, a screw is passed through the aperture in the plate and into a drawer. Adjustment of the position of the slide member with respect to the drawer is accomplished by slightly changing the angle of the slot using for example a screwdriver. Accordingly, the embodiment of FIG. 12 allows for somewhat circular motion in changing position of the slide member web.

Figure 13:
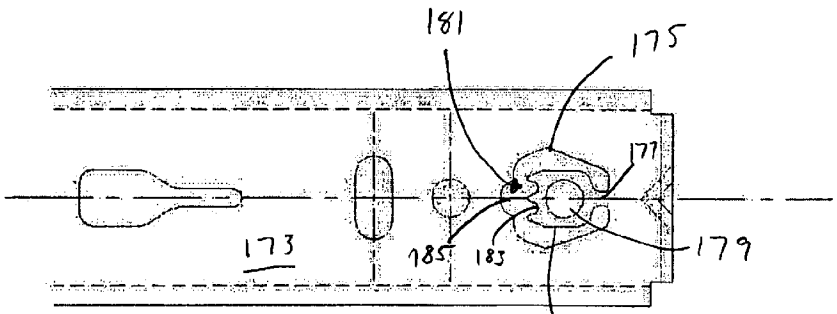
FIG. 13 illustrates a slide member with adjustment features in accordance with aspects of the invention.

FIG. 13 illustrates a further embodiment of the invention. In FIG. 13 an adjustment mechanism 171 is integrally formed in the web 173 of a slide member. The adjustment mechanism is formed in a substantially C-shaped aperture 175 in the web of the slide member, with a bridge 177 through the mouth of the C connecting the mechanism to the web. The mechanism is substantially square-shaped, with a screw hole 179 within its middle. An edge 181 of the mechanism away from the bridge includes notches 183. On the wall of the slide member web opposite the notches is a semi-circular cut-out 185. The space between the notches and semicircular cut-out is adapted to receive, for example, a screwdriver head. Placement of the screwdriver head in one of the notches in the cut-out allows rotation of the screwdriver head to adjust the position of the mechanism with respect to the web. In particular, rotation of the screwdriver causes a torque to be placed on the bridge, with the bridge thereby to cause to flex and to move. In operation, once the web is positioned as desired, a second screw may be placed in a second aperture to hold the web in place with respect to a drawer.

Figure 14:
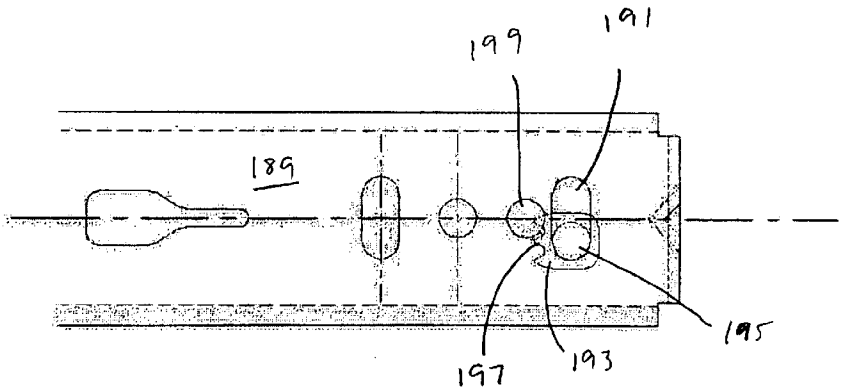
FIG. 14 illustrates a further embodiment of the invention providing a linear adjustment mechanism.

A further embodiment is illustrated in FIG. 14. In FIG. 14 a slide member web has a vertical elongate slot 191. Within the elongate slot is a toothed block 193 with a screw hole 195 in its middle. A screw (not shown) may be placed through the aperture and toothed block. Teeth 197 of the toothed block extend into a second aperture 199. Placement of, for example, a screwdriver head into the second aperture and in between the teeth allows for rotation of the screwdriver to effect movement of the toothed block within the vertical slot. Thus, with a screw passed through the second aperture, relative movement of the slide member web and a drawer to which the screw is attached may be achieved. Moreover, it may be achieved through linear movement of the tooth block, which forms an adjustment mechanism.

Figures 15, 16:
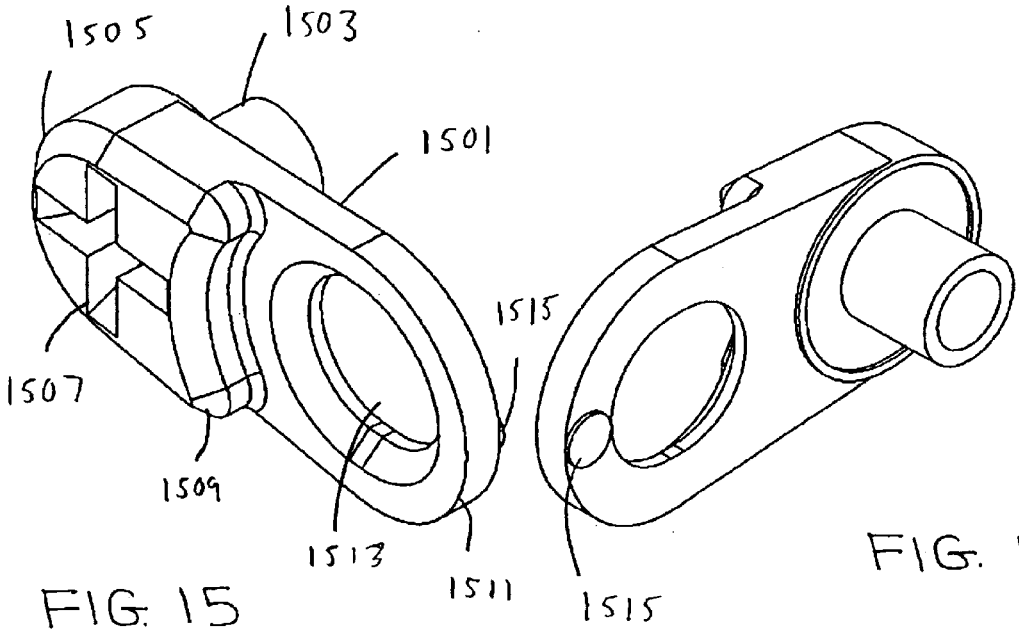
FIG. 15 illustrates a further embodiment of a camming mechanism in accordance with aspects of the present invention.
FIG. 16 illustrates a further view of the camming mechanism of FIG. 15.

FIG. 15 is a perspective view of an alternate embodiment of a camming mechanism in accordance with the present invention. The camming mechanism of FIG. 15 is similar to the cam of FIG. 6. The camming mechanism of FIG. 15 is a link shaped planar body 1501. A pin 1503 extends perpendicular to the planar body approximate a first semicircular end 1505 at the body. On the opposite side of the link shaped planar body from the pin is a slotted structure 1507. The slotted structure is within a built-up portion 1509. The slotted structure, as illustrated, is adapted to receive a screw driver.

Approximate an opposing second semicircular end 1511 is a counter-sunk pivot hole 1513. The pivot hole is adapted to receive a pin or screw. As shown in FIG. 16, the camming mechanism of FIGS. 15 and 16 does not include a rib about the hole. In the embodiment of FIGS. 15 and 16 a friction pad 1515 is approximate the hole. As illustrated the friction pad is towards an extreme end of the link shaped structure. The friction pad is also on the same side as the pin. In operation, rotation of the link through use of the slotted structure causes the friction pad to slide along the web of the drawer slide. Varying the features of the friction pad in various embodiments, such as by varying the size or shape, number, or composition of the friction pad, results in varying the friction impeding the movement of the link.

Figure 17:
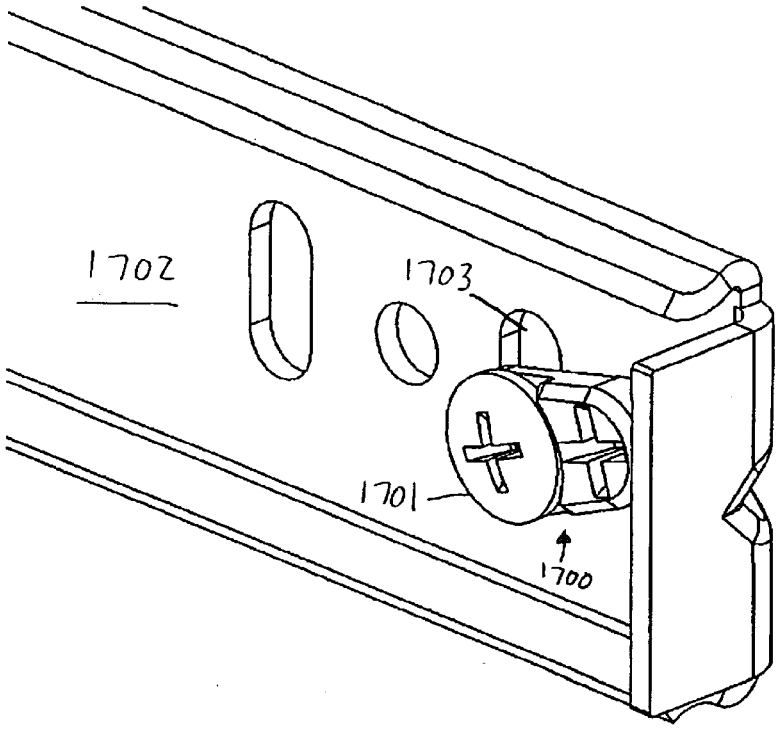
FIG. 17 illustrates the camming mechanism of FIGS. 15 and 16 in a drawer slide.
Figure 18:
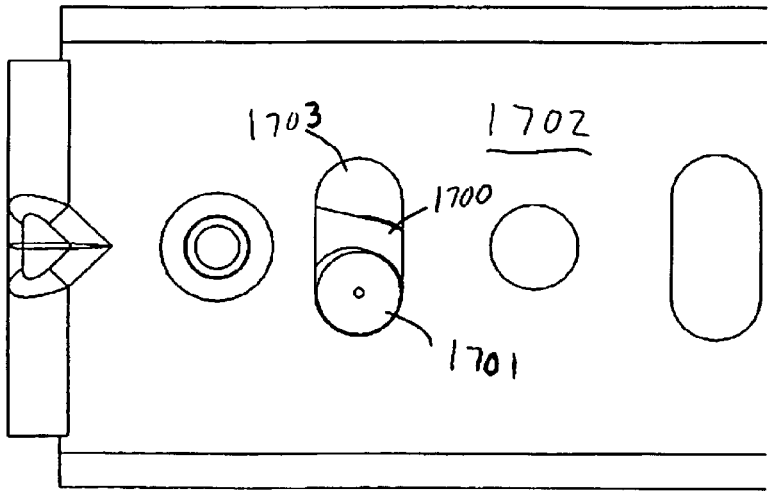
FIG. 18 illustrates a further view of the system of FIG. 17.

FIG. 17 illustrates a perspective view of the camming mechanism 1700 of FIGS. 15 and 16 mounted in a drawer slide 1702. As illustrated in FIG. 17, a screw 1701 has been placed in the hole of the camming mechanism, with the hole of the camming mechanism approximate an aperture 1703 in the drawer slide. FIG. 18 shows a planar view of the screw extending through a semi-rectangular aperture in the drawer slide.

In some embodiments, a friction pad, such as in the camming mechanism of FIGS. 15 and 16, is adapted to interact with a dimple, or a series of dimples in a drawer slide to provide detent features in movement of the camming mechanism. In some embodiments the friction pad fits within a well formed by the dimple, and in other embodiments the dimple is on the reverse side of the slide, thereby forming a protrusion which the friction pad contacts. In some embodiments multiple friction pads and/or multiple dimples are used.

Figure 19A:
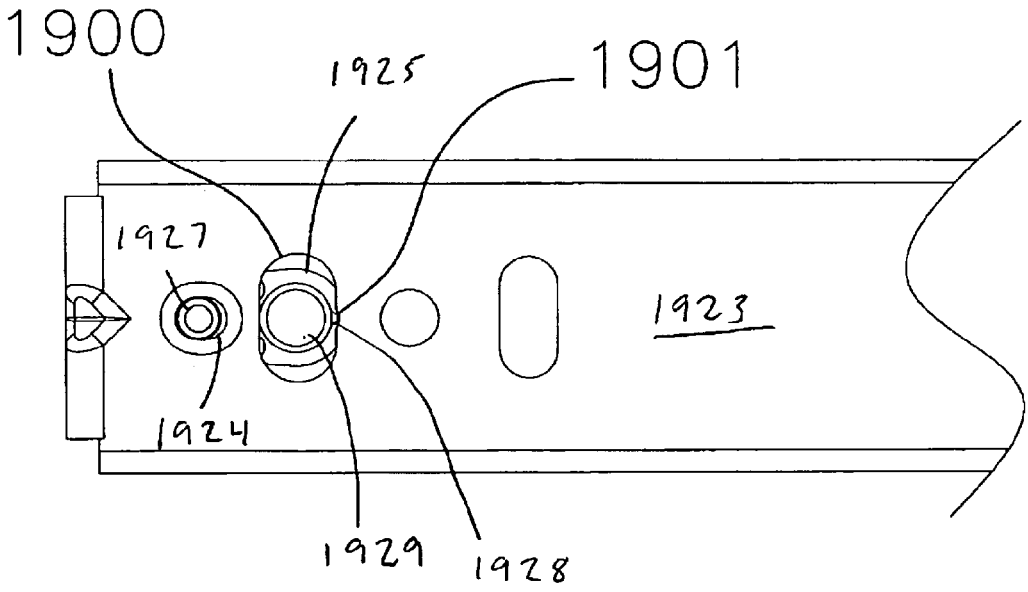
FIGS. 19A–C illustrate camming mechanisms and slide members with various cutouts which are useful in providing a centering detent position for the camming mechanism.
Figure 19B:
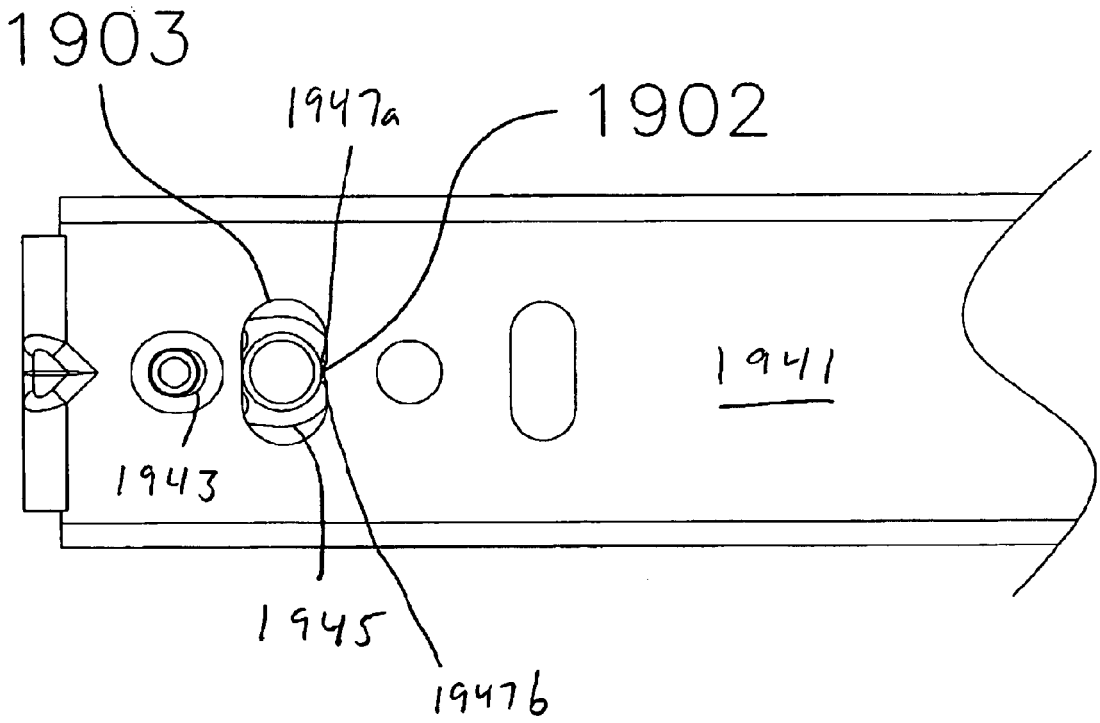
Figure 19C:
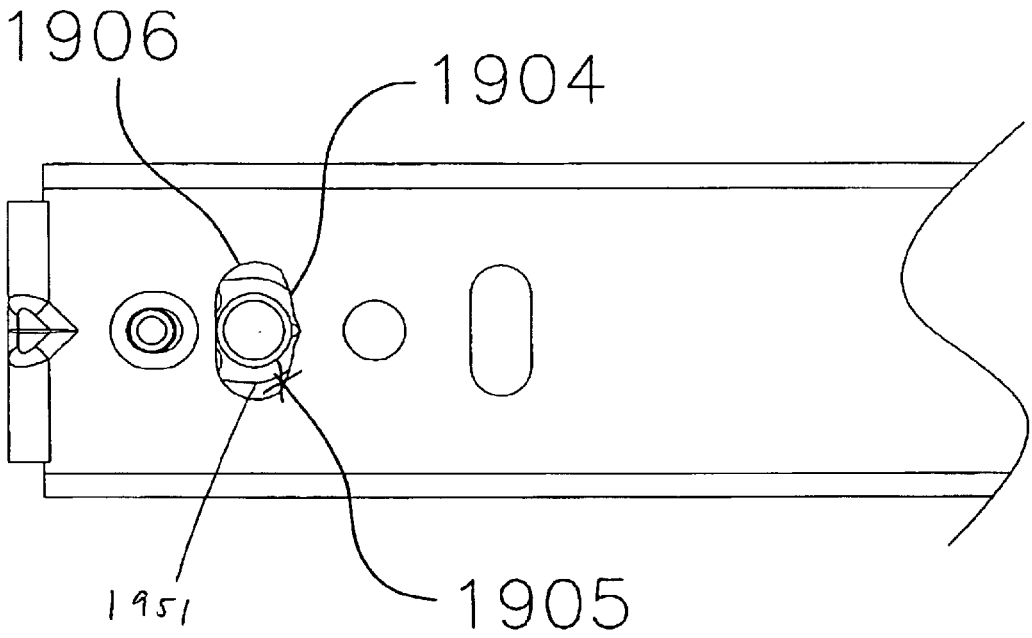

FIGS. 19A–C illustrate various cutouts which could be used to provide a centering detent position for the camming mechanism. The center position is useful for providing an initial installation position of the slide member. As illustrated in FIG. 19A, a drawer slide member 1923 includes an aperture 1924 and a slot 1900. A cam 1925 mechanism, sometimes termed a cam adjuster, has an extending cylinder 1927 inserted in the aperture. A pivot hole 1929 of the camming mechanism overlays the slot.

The slot includes a cutout shape 1901. The cutout shape extends away from the slot. The cutout shape accepts a friction pad 1928. As illustrated in FIG. 19A, the cutout shape is centered along one wall of the slot. Placement of the friction pad in the cutout shape therefore places the camming mechanism in the center position. The cutout shape provides a frictional interface for movement of the friction pad, and camming mechanism, providing a detent at the center position.

In FIG. 19B, a slide member 1941 includes a slot 1903 with a protruding shape 1902. The slide member includes an aperture 1943 as in the embodiment of FIG. 19A, and a camming mechanism 1945 is placed also as in the embodiment of FIG. 19A. As illustrated in FIG. 19B, the protruding shape is centered along one wall of the slot. The protruding shape is adapted to interact with a camming mechanism having two somewhat adjacent friction pads 1947*a,b*. Placement of the camming mechanism such that the protruding shape is between the friction pads centers the camming mechanism in the slot in a detent position. Use of multiple friction pads, including more than two friction pads, allows for multiple detent positions.

In FIG. 19C, angular walls 1904 and 1905 of one side of a slot 1906 create a center position for a friction pad. The angular walls also provide a varying amount of interference and friction as a camming, or adjustment, mechanism 1951 is rotated.

In some embodiments the cutout shape or protruding shape is replaced by a dimple placed in the slide member approximate the slot. The dimple, which forms a protrusion in the slide member towards or away from a friction pad of the camming mechanism, provides a frictional interface forming the detent position.

Figure 20A:
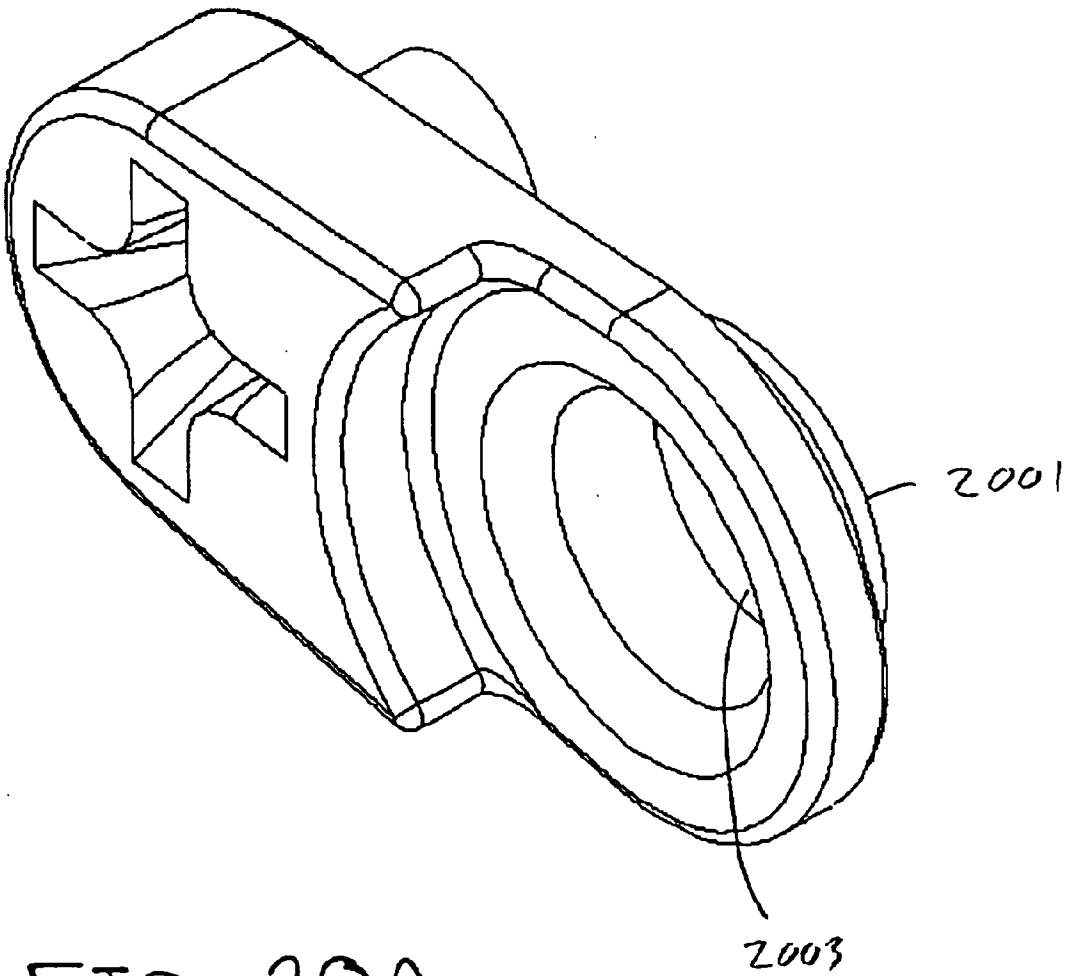
FIGS. 20A–B illustrate views of a camming mechanism with a further friction pad and a detent assist.
Figure 20B:
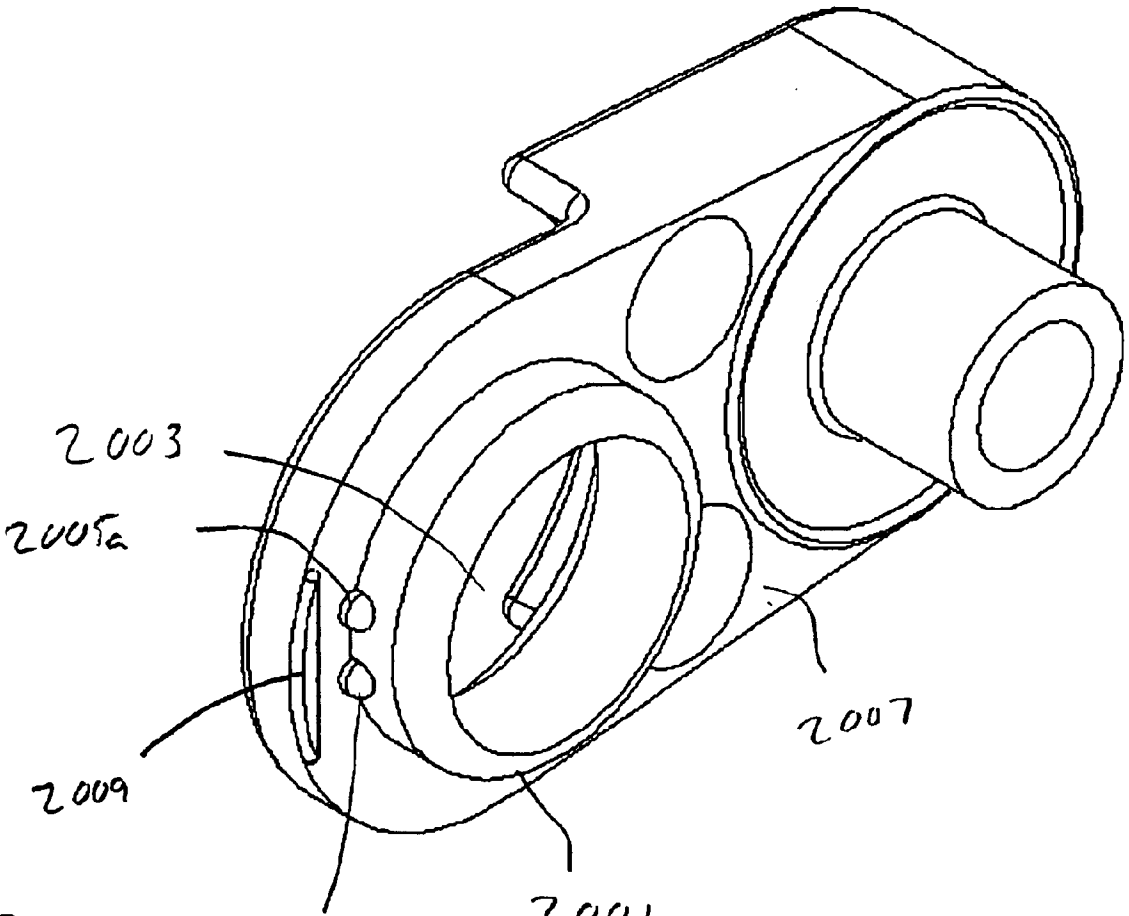

FIGS. 20A and 20B illustrate a further embodiment of a camming mechanism. The camming mechanism of FIGS. 20A and 20B include a rib 2001 along an adjustment hole 2003. The rib is adapted to be placed in a slot of a slide member. Two friction pads 2005*a,b* are placed along the rib. As illustrated the friction pads are an integral portion of the camming mechanism, and are bumps placed along the rib where it extends from a planar body 2007 of the camming mechanism. A third friction pad 2009 is placed along the outer edge of the planar body, and provides additional support to the camming mechanism, among other functions.

Figure 21:
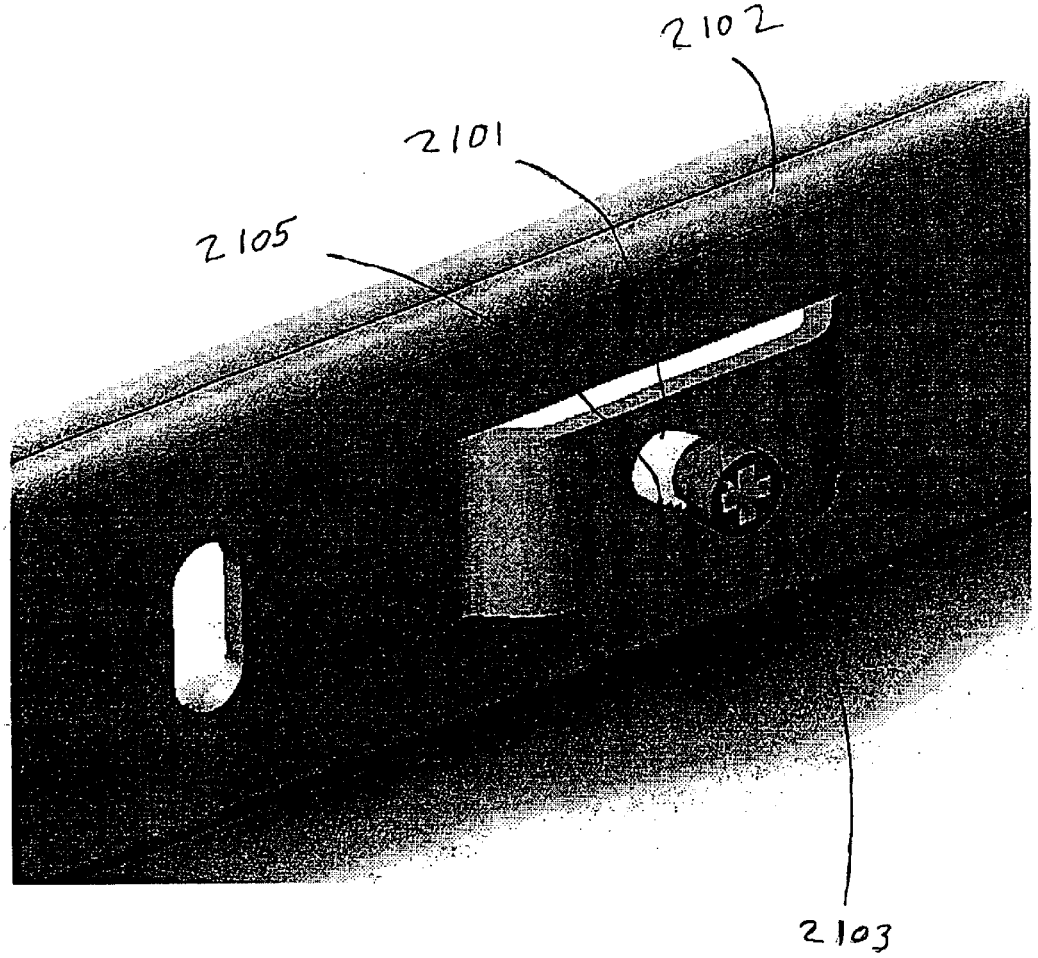
FIG. 21 illustrates a further embodiment in accordance with aspects of the invention.

FIG. 21 illustrates a drawer slide and camming mechanism adapted for use with a metal frame cabinet. In a metal frame cabinet a screw is passed through the metal frame and a web of a slide member. In the embodiment of FIG. 21 an aperture 2101 in a slide member 2102 receives a screw 2103. The aperture includes a series of notches 2105. Rotation of the screw, or camming mechanism, results in movement of the screw with respect to the notches. In such a way position of the slide member may be accomplished.

Accordingly, the present invention provides a drawer slide with an installation adjustment mechanism. Although this invention has been described in certain specific embodiments, it should be understood that this invention may be practiced otherwise than as specifically described. Thus, the present embodiments of the invention should be considered in all respects as illustrative and not restrictive, the scope of the invention to be determined by the claims, and their equivalents, supported herein as would be understood by those of skill in the art.

What is claimed is:

1. A drawer slide assembly having an adjustment mechanism comprising:

a first slide member;

a second slide member having a web and raceways along opposite margins of the web, with the web adapted for placement against a drawer, the second slide member slidably coupled to the first slide member;

an adjustment member pivotably attached to a fixed position on the web of the second slide member about a first point of the adjustment member, the adjustment member having a second point moveable over at least a portion of an elongate aperture in the web of the second slide member.

2. The drawer slide assembly having an adjustment mechanism of claim 1 wherein the adjustment member has one or more detent positions.

3. The drawer slide assembly having an adjustment mechanism of claim 1 wherein the adjustment member is a substantially link shaped partially planar body.

4. The drawer slide assembly having an adjustment mechanism of claim 3 wherein a rivet extends through the first point.

5. The drawer slide assembly having an adjustment mechanism of claim 4 wherein a friction pad is approximate the second point.

6. The drawer slide assembly having an adjustment mechanism of claim 1 wherein the adjustment member is pivotably attached to the second slide member towards a first end of the second slide member.

7. The drawer slide assembly having an adjustment mechanism of claim 6 further comprising a second adjustment member pivotably attached to the second slide member towards a second end of the second slide member.

8. The drawer slide assembly having an adjustment mechanism of claim 1 wherein the second point is in a hole in the adjustment member.

9. The drawer slide assembly having an adjustment mechanism of claim 8 wherein the hole is adapted to receive a screw.

10. The drawer slide assembly having an adjustment mechanism of claim 8 wherein the hole is adapted to receive a pin.

11. The drawer slide assembly having an adjustment mechanism of claim 4 wherein the second point is in a hole in the adjustment member.

12. A drawer slide assembly having an adjustment mechanism comprising:

a first slide member;

a second slide member slidably coupled to the first slide member;

an adjustment member pivotably attached to the second slide member about a first point of the adjustment member, the adjustment member having a second point moveable over at least a portion of an elongate aperture in the second slide member; and wherein the second point is in a hole in the adjustment member.

13. The drawer slide assembly having an adjustment mechanism of claim 12 wherein the hole is adapted to receive a screw.

14. The drawer slide assembly having an adjustment mechanism of claim 12 wherein the hole is adapted to receive a pin.

15. A drawer slide assembly having an adjustment mechanism comprising:

a first slide member;

a second slide member slidably coupled to the first slide member;

an adjustment member pivotably attached to the second slide member about a first point of the adjustment member, the adjustment member having a second point moveable over at least a portion of an elongate aperture in the second slide member; wherein the adjustment member is a substantially link shaped partially planar body;

wherein a rivet extends through the first point; and wherein the second point is in a hole in the adjustment member.

16. The drawer slide assembly having an adjustment mechanism of claim 15 further comprising a rib about a portion of the hole in the adjustment member.

17. A drawer slide assembly comprising:

a first slide member;

a second slide member longitudinally extendably coupled to the first slide member, the second slide member having a longitudinal web with bearing raceways extending from opposing edges of the web; and means, pivotably coupled to the web of the second slide member, to laterally adjust position of the second slide member.

18. The drawer slide assembly having an adjustment mechanism of claim 17 wherein the adjustment member has one or more detent positions.

19. The drawer slide assembly of claim 17, wherein the means to adjust the position of the second slide member includes a threaded member.

20. The drawer slide assembly of claim 19, wherein the threaded member extends through an aperture of the second slide member.

21. The drawer slide assembly of claim 17, wherein the means to adjust the position of the second slide member includes a screw.

22. The drawer slide assembly of claim 17, wherein the means to adjust the position of the second slide member includes a substantially link shaped member.

23. The drawer slide assembly of claim 17, wherein the means to adjust the position of the second slide member is pivotably coupled to the second slide member by a rivet.

24. A drawer slide assembly comprising:

a first slide member;

a second slide member longitudinally extendably coupled to the first slide member;

the second slide member having a longitudinal web with bearing raceways extending from opposing edges of the web;

means, pivotably coupled to the web of the second slide member, to laterally adjust position of the second slide member;

wherein the means to adjust the position of the second slide member includes a threaded member;

wherein the threaded member extends through an aperture of the second slide member; and wherein the threaded member is moveable through a distance within the aperture of the second slide member.

25. A drawer slide assembly comprising:

a first slide member;

a second slide member longitudinally extendably coupled to the first slide member;

the second slide member having a longitudinal web with bearing raceways extending from opposing edges of the web;

means, pivotably coupled to the web of the second slide member, to laterally adjust position of the second slide member;

wherein the means to adjust the position of the second slide member includes a threaded member; wherein the threaded member extends through an aperture of the second slide member; and wherein the aperture of the second slide member is substantially arc shaped.

* * * * *